United States Patent [19]

Ide et al.

[11] Patent Number: 5,053,267

[45] Date of Patent: Oct. 1, 1991

[54] THERMOSENSITIVE IMAGE TRANSFER RECORDING MEDIUM

[75] Inventors: Youji Ide, Mishima; Tetsuji Kunitake, Numazu; Masanaka Nagamoto, Susono; Yoshihiko Hiyoshi, Numazu, all of Japan

[73] Assignee: Ricoh Company, Ltd., Tokyo, Japan

[21] Appl. No.: 556,858

[22] Filed: Jul. 24, 1990

Related U.S. Application Data

[63] Continuation of Ser. No. 299,658, Jan. 23, 1989, abandoned.

[30] Foreign Application Priority Data

Feb. 1, 1988 [JP] Japan ..... 63-19596
Feb. 21, 1988 [JP] Japan ..... 63-11792
Apr. 4, 1988 [JP] Japan ..... 63-82832

[51] Int. Cl.[5] ..... B41M 5/20

[52] U.S. Cl. ..... 428/195; 428/212; 428/216; 428/336; 428/412; 428/473.5; 428/474.4; 428/484; 428/532; 428/913; 428/914

[58] Field of Search ..... 428/195, 484, 212, 215, 428/216, 913, 914, 336, 412, 473.5, 474.4, 532

[56] References Cited

U.S. PATENT DOCUMENTS 4,588,315 5/1986 Seto et al. ..... 400/120
4,707,406 11/1987 Inaba et al. ..... 428/488.1
4,720,480 1/1988 Ito et al. ..... 428/195

FOREIGN PATENT DOCUMENTS 3507097 9/1985 Fed. Rep. of Germany ... 428/488.1
1179787 8/1986 Japan ..... 428/488.1

*Primary Examiner*—Pamela R. Schwartz
*Attorney, Agent, or Firm*—Oblon, Spivak, McClelland, Maier & Neustadt

[57] ABSTRACT

A thermosensitive image transfer recording medium is disclosed, which comprises (a) a support, (b) a peel-off layer formed on the support, which comprises as the main component a thermofusible material, and has a melt viscosity A, and (c) a transparent thermofusible ink layer comprising a plurality of different color thermofusible ink sections, formed side by side in the form of a repeating unit on the peel-off layer, each thermofusible ink section comprising as the main components a thermofusible resin and a coloring agent and having a melt viscosity B which is larger than the melt viscosity A of the peel-off layer, with the melt viscosity A of the peel-off layer being in the range of 10 cps to 10,000 cps at 110° C., and the melt viscosity B of the thermofusible ink layer being in the range of 100 cps to 500,000 cps at 110° C.

23 Claims, 1 Drawing Sheet

THERMOSENSITIVE IMAGE TRANSFER RECORDING MEDIUM

This application is a Continuation of application Ser. No. 299,658, filed on Jan. 23, 1989, now abandoned.

BACKGROUND OF THE INVENTION

The present invention relates to a thermosensitive image transfer recording medium for reproduction of full-color images by thermal image transfer recording.

A conventional thermal image transfer recording method using thermofusible inks comprising a thermofusible material, for instance, wax, and a coloring agent has the following shortcomings:

(1) Since the inks penetrate an image receiving sheet when colored images are formed thereon, the quality of color reproduction is poor, and the reproduced colors tend to become dark.

(2) When images are formed by superimposing different colors, non-printed dot-shaped voids tend to be formed in the transferred images so that poor quality images are produced.

(3) When transferred images are rubbed, the images are easily spread, so that the background is smeared.

(4) When images are transferred to a sheet of paper having a relatively rough surface, the quality of the printed images becomes considerably poor.

(5) When high speed printing is performed by the conventional thermal image transfer recording method, the quality of printing images becomes considerably poor.

In order to eliminate the above-mentioned shortcomings, inks having high melt viscosity have been proposed. However, when such inks are used, the superimposing of the inks with different colors cannot be performed smoothly so that color reproduction is no good. Furthermore, when inks having high melt viscosity are used, the surface of the printed images is not so smooth that images with poor color contrast are produced and the thus produced images are not suitable for use with transparent originals for over-head projectors.

SUMMARY OF THE INVENTION

It is therefore an object of the present invention to provide a thermosensitive image transfer recording medium which is suitable for full-color recording and capable of reproducing printed images with high contrast at high speed even when a transfer sheet having a relatively rough surface is employed.

This object of the present invention can be achieved by a thermosensitive image transfer recording medium comprising a support, a peel-off layer formed on the support, which comprises as the main component a thermofusible material, and has a melt viscosity (A), and a transparent thermofusible ink layer comprising a plurality of different color thermofusible ink sections, formed side by side, constituting repeating units, on the peel-off layer, each thermofusible ink section comprising as the main components a coloring agent and a thermofusible resin and having a melt viscosity (B) which is larger than the melt viscosity (A) of the peel-off layer, with the melt viscosity (A) of the peel-off layer being in the range of 10 cps to 10,000 cps at 110° C., and the melt viscosity (B) of the thermofusible ink layer being in the range of 100 cps to 500,000 cps at 110° C. In this thermosensitive image transfer recording medium, it is preferable that the peel-off layer have an endothermic capacity in the range of 20 to 65 mcal/mg and the the thermofusible ink layer have an endothermic capacity of 10 mcal/mg or less.

DETAILED DESCRIPTION OF THE PREFERRED EMBODIMENTS

With reference to the accompanying drawings, the present invention will now be explained in more detail.

Figure 1:
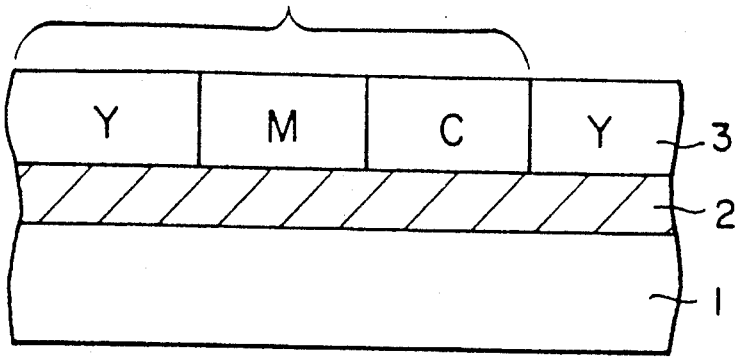
FIG. 1 is a schematic cross-sectional view of an example of a thermosensitive image transfer recording medium according to the present invention.

FIG. 1 is a schematic cross-sectional view of an example of a thermosensitive image transfer recording medium according to the present invention. In this example, on a support 1, there are successively formed a peel-off layer 2 and a transparent thermofusible ink layer 3 comprising a plurality of different color sections, a yellow ink section (Y), a magenta ink section (M), and a cyan ink section (C) formed side by side in the form of a repeating unit.

Figure 2:
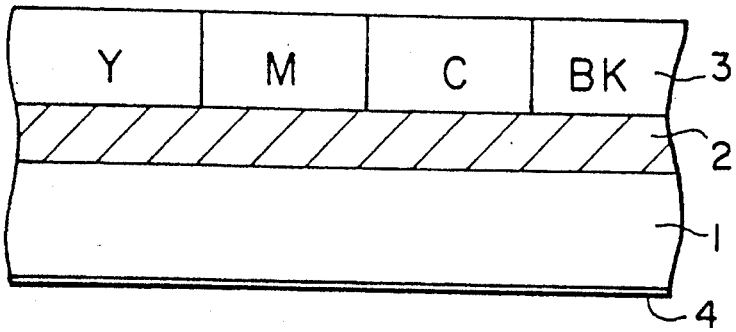
FIG. 2 is a schematic cross-sectional view of another example of a thermosensitive image transfer recording medium according to the present invention.

When necessary, a black ink section (Bk) may be added to the repeating unit as illustrated in FIG. 2. Further, a back layer 4 also may be provided on the back side of the support 1 in order to protect the support 1 from the heat of a thermal head (not shown) or in order to improve the running of the thermal head on the back side of the support 1.

Figure 3:
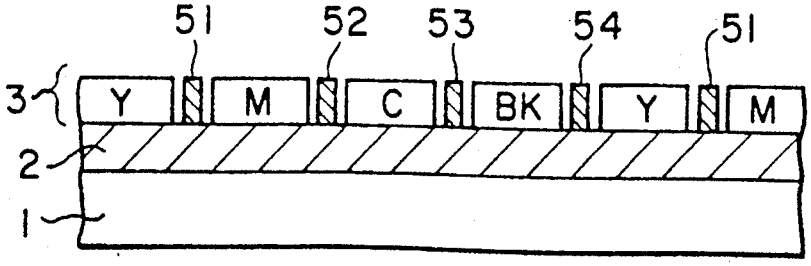
FIG. 3 is a schematic cross-sectional view of a further example of a thermosensitive image transfer recording medium according to the present invention.

When the thermosensitive image transfer medium is in the shape of a ribbon and is used as such a printing ribbon and the ink sections are formed on the peel-off layer 2 in stripes in the transverse direction of the peel-off layer 2 in a repeated, predetermined color order, narrow markers extending in the transverse direction 51, 52, 53 and 54 for identifying the color of the adjacent ink section may be placed between the adjacent ink sections as illustrated in FIG. 3.

As the material for the support 1, conventionally known films and paper can be employed. As such films and paper, it is preferable to use heat resistant plastic materials such as polyester, polycarbonate, triacetylcellulose, nylon and polyimide, and other heat resistant materials such as cellophane and parchment paper.

When a thermal head is used for thermal image transfer, it is preferable that the thickness of the support 1 be in the range of 2 to 15 μm. However, when the transparent thermofusible ink layer 3 can be selectively heated, for instance, by application of laser beams, there is no restriction to the thickness of the support 1.

As mentioned previously, the back layer 4 can be provided on the back side of the support 1. When a thermal head is employed for image transfer, the back layer 4 may be made of silicone resin, fluorine plastics, polyimide resin, epoxy resin, phenolic resin, melamine resin and nitrocellulose so as to serve as a heat-resistant protective layer for the support 1. By use of such a heat-resistant protective layer, materials which are not conventionally employed as the support 1 can also be employed.

The peel-off layer 2 serves to facilitate the transfer of the thermofusible ink sections to a transfer sheet when thermally transferred and to facilitate the superimposing transfer of a plurality of the thermofusible ink sections to the transfer sheet by eliminating or minimizing the difference in the transfer degree between (i) the transfer of the thermofusible ink sections to a transfer sheet and (ii) the transfer of the thermofusible ink sections to the ink section already transferred to the transfer sheet.

The thermofusible ink sections are transparent or substantially transparent and are capable of forming full-color images by superimposing a yellow ink section magenta ink section, and/or a cyan ink section.

Examples of the thermofusible material for use in the peel-off layer 2 are natural waxes such as spermaceti, bees wax, lanolin, carnauba wax, candelilla wax, montan wax and cercin wax, and petroleum waxes such as paraffin wax and microcrystalline wax, and synthetic waxes such as oxidized wax and ester wax (hereinafter referred to as Thermofusible Material Group A); synthetic waxes such as low-molecular-weight polyethylene and Fischer-Tropish wax; higher fatty acids such as lauric acid, myristic acid, palmitic acid, stearic acid, behenic acid; higher alcohols such as stearyl alcohol and behenyl alcohol; esters such as fatty acid esters of sucrose and fatty acid esters of sorbitan; and amides such as stearamide and oleamide (hereinafter referred to as Thermofusible Material Group B).

When necessary, the following thermofusible materials can be employed in combination with the above-mentioned thermofusible materials in the peel-off layer 2: polyamide resin, polyester resin, epoxy resin, polyurethane resin, acrylic resin, vinyl chloride resin, cellulose resin, polyvinyl alcohol resin, petroleum resin, phenolic resin, styrene resin, ethylene - acrylic resin, and elastomers such as natural rubber, styrene - butadiene rubber, isoprene rubber, and chloroprene rubber (hereinafter referred to as Thermofusible Material Group C).

When the endothermic capacity of the thermofusible peel-off layer 2 is in the range of 20 to 65 mcal/mg, the physical properties of the peel-off layer 2 change sharply upon application of heat thereto to the extent that a heated portion and an unheated portion of the peel-off layer 2 can be clearly separated, so that sharp image transfer can be performed without the formation of non-transferred dot-shaped voids in the transferred images, in such a manner as to be suitable for high speed printing.

The endothermic capacity of the thermofusible peel-off layer 2 is measured by recording a DSC curve of a sample of the peel-off layer 2 by a commercially available thermal analyzer (Trademark "DT-30" made by Shimadzu Corporation) and calculating the peak area enclosed by the DSC curve in accordance with the following formula:

Endothermic capacity=(Peak Area)/(Mass of Sample of Peel-off Layer)

In order to obtain a peel-off layer having an endothermic capacity in the range of 20 to 65 mcal/mg, it is preferable that the peel-off layer be prepared by use of a material in Thermofusible Material Group A as the main component, and when necessary, any of the materials in Thermofusible Material Group B and/or in Thermofusible Material Group C may be used in combination with the material in Thermofusible Material Group A.

Furthermore, the thermofusible ink layer 3 having a melt viscosity which is larger than the melt viscosity of the peel-off layer has the advantage that when an ink section is superimposed on an ink section which has already been transferred to a transfer sheet, the transfer of the ink section to the already transferred ink section can be securely performed.

More specifically, it is preferable that the melt viscosity A of the thermofusible peel-off layer 2 be in the range of 10 cps to 10,000 cps at 110° C., and the melt viscosity B of the thermofusible ink layer 3 be in the range of 100 cps to 500,000 cps at 110° C.

Examples of a thermofusible resin for use in the thermofusible ink layer 3 are polyethylene resin, polyamide resin, polyester resin, ethylene - vinyl acetate copolymer resin, ethylene - acrylic copolymer resin, epoxy resin, polyurethane resin, acrylic resin, vinyl chloride resin, cellulose resin, polyvinyl alcohol resin, petroleum resin, phenolic resin, styrene resin, and elastomers such as natural rubber, styrene - butadiene rubber, isoprene rubber, and chloroprene.

To the thermofusible ink layer 3, in addition to any of the above thermofusible resins, the thermofusible materials employed as the main component of the peel-off layer 2, plasticizers such as dioctyl phthalate and dibutyl phthalate, mineral oils and vegetable oils may be added so long as the melt viscosity of the thermofusible ink layer 3 can be maintained in the above-mentioned range.

In the ink layer 3, it is preferable that the weight ratio of the thermofusible resin to a coloring agent be 1:about 0.0 to about 0.63. Further it is preferable that the ink layer 3 comprising as the main components a coloring agent and the thermofusible resin have an endothermic capacity of 10 mcal/mg or less for preventing the ink layer 3 from becoming liquified and penetrating into a transfer paper during the course of thermal printing.

For producing clear full-color images by superimposing a plurality of the ink sections, it is preferable that the peel-off layer 2 have a thickness ranging from 1.0 to 6.0 μm, more preferably a thickness ranging from 2.0 to 4.0 μm, and that the ink layer 3 have a thickness ranging from 0.2 to 5.0 μm, more preferably a thickness ranging from 0.5 to 2.5 μm.

As the coloring agents for use in the ink layer, conventionally employed pigments and dyes can be employed. Specifically, C.I. Pigment Yellow 12, Yellow FGN, Chrome Yellow, Quinoline Yellow (C.I. 47005), C.I. Pigment Red 57:1, Rose Bengale, Monastral Red, C.I. Pigment Blue 15:3, Aniline Blue, Calconyl Blue, Phthalocyanine Blue, Ultramarine Blue.

A method of preparing the thermosensitive image transfer recording medium according to the present invention will now be explained.

A peel-off layer coating liquid is prepared by using any of the previously mentioned thermofusible materials and other materials. The peel-off layer coating liquid is then coated on a support uniformly or with predetermined patterns corresponding to an ink layer to be formed thereon, for instance, by the conventional hot-melt coating method and the solvent coating method.

Ink layer coating liquids are prepared by dissolving or dispersing any of the previously mentioned thermofusible resins, coloring agents, and other components in an organic solvent such as toluene. Each of the thus prepared ink section coating liquids is then successively coated on the peel-off layer 2 uniformly or with predetermined patterns so as to form repeated units consisting of a yellow ink section, a magenta ink section, and a cyan ink section, or with addition thereto of a black ink section, whereby a thermosensitive image transfer recording medium according to the present invention can be prepared.

Full-color images can be formed on a transfer sheet by successively superimposing each ink section of the above-prepared thermosensitive image transfer recording medium.

The feature of the present invention will become apparent in the course of the following description of exemplary embodiments which are given for illustration of the invention and are not intended to be limiting thereof.

EXAMPLE 1

A peel-off layer coating liquid was prepared by mixing 7 parts by weight of a paraffin wax (m.p. 68.3°) and 3 parts by weight of lanolin fatty acid mono.di-mixed glyceride (m.p. 72° C.).

The thus prepared peel-off layer coating liquid was coated on one side of a polyethylene terephthalate film (hereinafter referred to as PET film) having a thickness of 3.5 μm by a hot melt flexographic printing method, whereby a peel-off layer having a thickness of 3.0 μm, a melt viscosity of 31 cps at 110° C., and an endothermic capacity of 45 mcal/mg was formed on the PET film.

Yellow, magenta and cyan ink section coating liquids were prepared by mixing the respective components with the following formulations:

| | Parts by Weight |
|---|---|
| [Yellow Ink Section Coating Liquid] | |
| C.I. Pigment Yellow 12 (coloring agent) | 22 |
| Lanolin fatty acid mono.di-mixed glyceride (m.p. 72° C.)(thermo-fusible material) | 55 |
| Ethylene.vinyl acetate copolymer containing 19% of vinyl acetate, MFR(ASTMD-1238) 2500 (thermo-fusible material) | 23 |
| Toluene (solvent) | 400 |
| [Magenta Ink Section Coating Liquid] | |
| C.I. Pigment Red 57:1 (coloring agent) | 26 |
| Lanolin fatty acid mono.di-mixed glyceride (m.p. 72° C.)(thermo-fusible material) | 52 |
| Ethylene.vinyl acetate copolymer containing 19% of vinyl acetate, MFR(ASTMD-1238) 2500 (thermo-fusible material) | 22 |
| Toluene (solvent) | 400 |
| [Cyan Ink Section Coating Liquid] | |
| C.I. Pigment Blue 15:3 (coloring agent) | 28 |
| Lanolin fatty acid mono.di-mixed glyceride (m.p. 72° C.)(thermo-fusible material) | 50 |
| Ethylene.vinyl acetate copolymer containing 19% of vinyl acetate, MFR(ASTMD-1238) 2500 (thermo-fusible material) | 22 |
| Toluene (solvent) | 400 |

The thus prepared yellow, magenta and cyan ink section coating liquids were respectively coated with a thickness of 0.5 μm when dried on the peel-off layer with a configuration as illustrated in FIG. 1, whereby a yellow ink section, a magenta ink section and a cyan ink section, each ink section having a melt viscosity of 3500 cps at 110° C. and an endothermic capacity of 9.5 mcal/mg, were formed on the peel-off layer. Thus, a thermosensitive image transfer recording medium No. 1 according to the present invention was prepared.

COMPARATIVE EXAMPLE 1

Yellow, magenta and cyan ink section coating liquids were prepared by mixing the respective components with the following formulations:

| | Parts by Weight |
|---|---|
| [Yellow Ink Section Coating Liquid] | |
| C.I. Pigment Yellow 12 (coloring agent) | 6 |
| Lanolin fatty acid mono.di-mixed glyceride (m.p. 72° C.)(thermo-fusible material) | 66 |
| Ethylene.vinyl acetate copolymer containing 19% of vinyl acetate, MFR(ASTMD-1238) 2500 (thermo-fusible material) | 28 |
| Toluene (solvent) | 400 |
| [Magenta Ink Section Coating Liquid] | |
| C.I. Pigment Red 57:1 (coloring agent) | 7 |
| Lanolin fatty acid mono.di-mixed glyceride (m.p. 72° C.)(thermo-fusible material) | 65 |
| Ethylene.vinyl acetate copolymer containing 19% of vinyl acetate, MFR(ASTMD-1238) 2500 (thermo-fusible material) | 28 |
| Toluene (solvent) | 400 |
| [Cyan Ink Section Coating Liquid] | |
| C.I. Pigment Blue 15:3 (coloring agent) | 8 |
| Lanolin fatty acid mono.di-mixed glyceride (m.p. 72° C.)(thermo-fusible material) | 64 |
| Ethylene.vinyl acetate copolymer containing 19% of vinyl acetate, MFR(ASTMD-1238) 2500 (thermo-fusible material) | 28 |
| Toluene (solvent) | 400 |

The thus prepared yellow, magenta and cyan ink section coating liquids were respectively coated on a PET film having a thickness of 3.5 μm by a hot melt flexographic printing method, whereby a yellow ink section, a magenta ink section, and a cyan ink section were formed on the PET film with a configuration as illustrated in FIG. 1, each layer having a thickness of 3.5 μm, a melt viscosity of 3200 cps at 110° C., and an endothermic capacity of 11 mcal/mg. Thus a comparative thermosensitive image transfer recording medium No. 1 was prepared.

The above prepared thermosensitive image transfer recording medium No. 1 according to the present invention and the comparative thermosensitive image transfer recording medium No. 1 were subjected to thermal image transfer printing on a commercially available paper having a Bekk's smoothness of 30 seconds by use of a commercially available thermal printing apparatus (Trademark "JP-70D" made by Ricoh Co., Ltd.). The results are shown in the following Table 1:

TABLE 1

| Recording Medium Characteristics | Example 1 | Comparative Example 1 |
|---|---|---|
| Presence of | None | More than 100 in |

TABLE 1-continued

| Recording Medium Characteristics | Example 1 | Comparative Example 1 |
|---|---|---|
| Non-printed Dots | | 500 dots |
| Reproduction of Dots | Almost no imperfect dots | Many imperfect dots |
| Superimposition of Colors | Good* | Poor |
| Resistance of Printed Image to Friction | Good | Fringe of Printed Printed Image Area** Looked Smeared |

(Note)
*Uniform superimposition of colors
**Underlying colors are sparcely visible

EXAMPLE 2

A peel-off layer coating liquid was prepared by mixing 7 parts by weight of a paraffin wax (m.p. 68.3°) and 3 parts by weight of lanolin fatty acid mono.di-mixed glyceride (m.p. 72° C.).

The thus prepared peel-off layer coating liquid was coated on one side of a PET film having a thickness of 3.5 μm by a hot melt flexographic printing method, whereby a peel-off layer having a thickness of 3.0 μm, a melt viscosity of 31 cps, and an endothermic capacity of 45 mcal/mg was formed on the PET film.

Yellow, magenta and cyan ink section coating liquids were prepared by mixing the respective components with the following formulations:

| | Parts by Weight |
|---|---|
| [Yellow Ink Section Coating Liquid] | |
| C.I. Pigment Yellow 12 (coloring agent) | 14 |
| Ethylene.vinyl acetate copolymer containing 19% of vinyl acetate, MFR(ASTMD-1238) 400 (thermo-fusible material) | 46 |
| Polystyrene (softening point of 80° C. measured by the ring and ball test) | 46 |
| Toluene (solvent) | 400 |
| [Magenta Ink Section Coating Liquid] | |
| C.I. Pigment Red 57:1 (coloring agent) | 16 |
| Ethylene.vinyl acetate copolymer containing 19% of vinyl acetate, MFR(ASTMD-1238) 400 (thermo-fusible material) | 43.5 |
| Polystyrene (softening point of 80° C. measured by the ring and ball test) | 43.5 |
| Toluene (solvent) | 400 |
| [Cyan Ink Section Coating Liquid] | |
| C.I. Pigment Blue 15:3 (coloring agent) | 28 |
| Ethylene.vinyl acetate copolymer containing 19% of vinyl acetate, MFR(ASTMD-1238) 400 (thermo-fusible material) | 42.5 |
| Polystyrene (softening point of 80° C. measured by the ring and ball test) | 42.5 |
| Toluene (solvent) | 400 |

The thus prepared yellow, magenta and cyan ink section coating liquids were respectively coated on the peel-off layer with a thickness of 1.5 μm with a configuration as illustrated in FIG. 1, whereby a yellow ink section, a magenta ink section and a cyan ink section, each ink section having a melt viscosity of 150,000 cps at 110° C. and an endothermic capacity of 3 mcal/mg, were formed on the peel-off layer. Thus, a thermosensitive image transfer recording medium No. 2 according to the present invention was prepared.

COMPARATIVE EXAMPLE 2

Yellow, magenta and cyan ink section coating liquids were prepared by mixing the respective components with the following formulations:

| | Parts by Weight |
|---|---|
| [Yellow Ink Section Coating Liquid] | |
| C.I. Pigment Yellow 12 (coloring agent) | 5 |
| Ethylene.vinyl acetate copolymer containing 19% of vinyl acetate, MFR(ASTMD-1238) 400 (thermo-fusible material) | 47.5 |
| Polystyrene softening point of 80° C. measured by the ring and ball test) | 47.5 |
| Toluene (solvent) | 400 |
| [Magenta Ink Section Coating Liquid] | |
| C.I. Pigment Red 57:1 (coloring agent) | 6 |
| Ethylene.vinyl acetate copolymer containing 19% of vinyl acetate, MFR(ASTMD-1238) 400 (thermo-fusible material) | 47 |
| Polystyrene (softening point of 80° C. measured by the ring and ball test) | 47 |
| Toluene (solvent) | 400 |
| [Cyan Ink Section Coating Liquid] | |
| C.I. Pigment Blue 15:3 (coloring agent) | 7 |
| Ethylene.vinyl acetate copolymer containing 19% of vinyl acetate, MFR(ASTMD-1238) 400 (thermo-fusible material) | 46.5 |
| Polystyrene (softening point of 80° C. measured by the ring and ball test) | 46.5 |
| Toluene (solvent) | 400 |

The thus prepared yellow, magenta and cyan ink section coating liquids were respectively coated on a PET film having a thickness of 3.5 μm by a photogravure printing method, whereby a yellow ink section, a magenta ink section, and a cyan ink section were formed on the PET film with a configuration as illustrated in FIG. 1, each ink layer having a thickness of 3.5 μm, a melt viscosity of 120,000 cps at 110° C., and an endothermic capacity of 4 mcal/mg. Thus a comparative thermosensitive image transfer recording medium No. 2 was prepared.

The above prepared thermosensitive image transfer recording medium No. 2 according to the present invention and the comparative thermosensitive image transfer recording medium No. 2 were subjected to thermal image transfer printing on a commercially available Lancaster bond paper having a Bekk's smoothness of 2 seconds by use of a serial thermal head under the following conditions:

The printing speed was 80 cps (characters per second), the printing energy was 14 mJ/mm$^2$, the pressure applied by the thermal head was 600 g, and the ink sections were peeled off the paper with an angle of about 60° immediately after the application of a pulse of the printing energy by the thermal head.

The superimposition of the colors was performed in the order of yellow, magenta and cyan.

The results are show in the following Table 2.

TABLE 2

| Recording Medium Characteristics | Example 2 | Comparative Example 2 |
|---|---|---|
| Presence of Non-printed Dots | None | More than 100 in 500 dots |

TABLE 2-continued

| Recording Medium Characteristics | Example 2 | Comparative Example 2 |
|---|---|---|
| Reproduction of Dots | Almost no imperfect dots | Many imperfect dots |
| Superimposition of Colors | Good* | Poor** |
| Other Defects in Printed Images | None | Peel off of ink layers, in particular among dots |

(Note)
*Uniform superimposition of colors
**Underlying colors are sparcely visible

EXAMPLE 3

The following components were dispersed in toluene in a ball mill, whereby a peel-off layer coating liquid was prepared:

| | Parts by Weight |
|---|---|
| Candelilla wax | 20 |
| Paraffin wax (softening point: about 60° C.) | 50 |
| Polyethylene wax (softening point: about 100° C.) | 30 |

The thus prepared peel-off layer coating liquid was coated on one side of a PET film having a thickness of 6 μm and dried, whereby a peel-off layer having a thickness of 4 μm, a melt viscosity of 650 cps at 110° C., and an endothermic capacity of 30 mcal/mg was formed on the PET film.

Yellow, magenta, cyan and black ink section coating compositions were prepared by mixing the respective components with the following formulations:

| | Parts by Weight |
|---|---|
| [Yellow Ink Section Coating Composition] | |
| Yellow FGN (made by Toyo Ink Mfg. Co., Ltd.) (coloring agent) | 6.5 |
| Ethylene.vinyl acetate copolymer (Trademark "Sumitate KE-10" made by Sumitomo Chemical Co., Ltd.) | 55.5 |
| Ethylene.vinyl acetate copolymer (Trademark "Sumitate DB-10" made by Sumitomo Chemical Co., Ltd.) | 28 |
| Terpene polymer (Trademark "Ys Resin Px-900" made by Yasuhara Yushi Co., Ltd.) | 10 |
| [Magenta Ink Section Coating Composition] | |
| Seika Fast Carmine 1458 (made by Dainichiseika Color and Chemicals Mfg. Co, Ltd.) (coloring agent) | 8 |
| Ethylene.vinyl acetate copolymer (Trademark "Sumitate KE-10" made by Sumitomo Chemical Co., Ltd.) | 54 |
| Ethylene.vinyl acetate copolymer (Trademark "Sumitate DB-10" made by Sumitomo Chemical Co., Ltd.) | 25 |
| Terpene polymer (Trademark "Ys Resin Px-900" made by Yasuhara Yushi Co., Ltd.) | 13 |
| [Cyan Ink Section Coating Composition] | |
| Lionol Blue KL (made by Toyo Ink Mfg. Co., Ltd.) (coloring agent) | 9 |
| Ethylene.vinyl acetate copolymer (Trademark "Sumitate KE-10" made by Sumitomo Chemical Co., Ltd.) | 54 |
| Ethylene.vinyl acetate copolymer (Trademark "Sumitate DB-10" made by Sumitomo Chemical Co., Ltd.) | 25 |

-continued

| | Parts by Weight |
|---|---|
| Terpene polymer (Trademark "Ys Resin Px-900" made by Yasuhara Yushi Kogyo Co., Ltd.) | 12 |
| [Black Ink Section Coating Composition] | |
| Carbon black (carbon black) | 13 |
| Ethylene.vinyl acetate copolymer (Trademark "Sumitate KE-10" made by Sumitomo Chemical Co., Ltd.) | 54 |
| Ethylene.vinyl acetate copolymer (Trademark "Sumitate DB-10" made by Sumitomo Chemical Co., Ltd.) | 22 |
| Terpene polymer (Trademark "Ys Resin Px-900" made by Yasuhara Yushi Co., Ltd.) | 11 |

The thus prepared yellow, magenta, cyan and black ink section coating liquids were respectively coated on the peel-off layer with a thickness of 2 μm by the hot melt gravure printing method with a configuration as illustrated in FIG. 3, whereby a yellow ink section, a magenta ink section, a cyan ink section, and a black ink section, each ink section having a melt viscosity of 210,000 cps at 110° C. and an endothermic capacity of 0.2 mcal/mg, were formed, with any of the markers 51, 52, 53 and 54, made of the above-mentioned black ink section coating composition, interposed between the adjacent ink sections on the peel-off layer. Thus, a thermosensitive image transfer recording medium No. 3 according to the present invention was prepared.

EXAMPLE 4

The procedure for Example 3 was repeated except that the peel-off layer coating liquid employed in Example 3 was was replaced by a peel-off layer coating liquid with the following formulation, whereby a thermosensitive image transfer recording medium No. 4 according to the present invention was prepared.

| | Parts by Weight |
|---|---|
| Carnauba wax | 15 |
| Paraffin wax (softening point: about 60° C.) | 50 |
| Rice wax (Trademark "F1" made by Noda Wax Co., Ltd.) | 30 |
| Terpene polymer (Trademark "Ys Resin Px-900" made by Yasuhara Yushi Co., Ltd.) | 5 |

The peel-off layer of this thermosensitive image transfer recording medium had a melt viscosity of 70 cps at 110° C. and an endothermic capacity of 42 mcal/mg.

EXAMPLE 5

The procedure for Example 3 was repeated except that the the yellow, magenta, cyan and black ink section coating compositions employed in Example 3 were respectively replaced by the yellow, magenta, cyan and black ink section coating compositions with the following formulations, whereby a thermosensitive image transfer recording medium No. 5 according to the present invention was prepared.

Each of thus prepared yellow, magenta, cyan and black ink sections had a melt viscosity of 180,000 cps at 110° C. and an endothermic capacity of 0.3 mcal/mg.

| | Parts by Weight |
|---|---|
| [Yellow Ink Section Coating Composition] | |
| Yellow FGN (made by Toyo Ink Mfg. Co., Ltd.) (coloring agent) | 6.5 |
| Ethylene.vinyl acetate copolymer (Trademark "Sumitate KE-10" made by Sumitomo Chemical Co., Ltd.) | 55.5 |
| Polyethylene wax (Trademark "Hoechst Wax RT" commercially available from Hoechst Japan Ltd.) | 5 |
| Ethylene.vinyl acetate copolymer (Trademark "Evaflex 210" made by Du Pont - Mitsui Polychemicals Co., Ltd.) | 23 |
| Terpene polymer (Trademark "Ys Resin Px-900" made by Yasuhara Yushi Co., Ltd.) | 20 |
| [Magenta Ink Section Coating Composition] | |
| Seika Fast Carmine 1458 (made by Dainichiseika Color and Chemicals Mfg. Co, Ltd.) (coloring agent) | 8 |
| Ethylene.vinyl acetate copolymer (Trademark "Sumitate KE-10" made by Sumitomo Chemical Co., Ltd.) | 54 |
| Polyethylene wax (Trademark "Hoechst Wax RT" commercially available from Hoechst Japan Ltd.) | 5 |
| Ethylene.vinyl acetate copolymer (Trademark "Evaflex 210" made by Du Pont - Mitsui Polychemicals Co., Ltd.) | 20 |
| Terpene polymer (Trademark "Ys Resin Px-900" made by Yasuhara Yushi Co., Ltd.) | 13 |
| [Cyan Ink Section Coating Composition] | |
| Lionol Blue KL (made by Toyo Ink Mfg. Co., Ltd.) (coloring agent) | 9 |
| Ethylene.vinyl acetate copolymer (Trademark "Sumitate KE-10" made by Sumitomo Chemical Co., Ltd.) | 54 |
| Polyethylene wax (Trademark "Hoechst Wax RT" commercially available from Hoechst Japan Ltd.) | 5 |
| Ethylene.vinyl acetate copolymer (Trademark "Evaflex 210" made by Du Pont - Mitsui Polychemicals Co., Ltd.) | 20 |
| Terpene polymer (Trademark "Ys Resin Px-900" made by Yasuhara Yushi Co., Ltd.) | 12 |
| [Black Ink Section Coating Composition] | |
| Carbon black (carbon black) | 13 |
| Ethylene.vinyl acetate copolymer (Trademark "Sumitate KE-10" made by Sumitomo Chemical Co., Ltd.) | 54 |
| Polyethylene wax (Trademark "Hoechst Wax RT" commercially available from Hoechst Japan Ltd.) | 5 |
| Ethylene.vinyl acetate copolymer (Trademark "Evaflex 210" made by Du Pont - Mitsui Polychemicals Co., Ltd.) | 17 |
| Terpene polymer (Trademark "Ys Resin Px-900" made by Yasuhara Yushi Co., Ltd.) | 11 |

COMPARATIVE EXAMPLE 3

The procedure for Example 3 was repeated except that the peel-off layer employed in Example 3 was replaced by a peel-off layer consisting of a polyethylene wax (Trademark "Hoechst Wax PED" commercially available from Hoechst Japan Ltd.), having a melt viscosity of 100,000 cps at 110° C. and an endothermic capacity of 4 mcal/mg, whereby a comparative thermosensitive image transfer recording medium No. 3 was prepared.

COMPARATIVE EXAMPLE 4

The procedure for Example 3 was repeated except that the ethylene.vinyl acetate copolymer (Trademark "Sumitate KE-10" made by Sumitomo Chemical Co., Ltd.) and ethylene. vinyl acetate copolymer (Trademark "Sumitate DB-10" made by Sumitomo Chemical Co., Ltd.) employed in the formulation of each ink section in Example 3 were respectively replaced by the rice wax employed in Example 4 and the ethylene.vinyl acetate copolymer (Trademark "Sumitate KE-10" made by Sumitomo Chemical Co., Ltd.), whereby a comparative thermosensitive image transfer recording medium No. 4 was prepared.

Each of the thus prepared ink sections had a melt viscosity of 600 cps at 110° C. and an endothermic capacity of 27 mcal/mg.

The thus prepared thermosensitive image transfer recording media No. 3 to No. 5 according to the present invention and comparative image transfer recording media No. 3 and No. 4 were subjected to single color printing and multiple superimposing color printing by a commercially available thermal printer (Trademark "Riport 70D" made by Ricoh Co., Ltd.). The results are shown in the following Table 3:

TABLE 3

| | Single Color Printing | Multi-color Superimposing Printing |
|---|---|---|
| Example 3 | 3 | Good |
| Example 4 | 3 | Good |
| Example 5 | 3 | Good |
| Comparative Example 3 | 1 | No Good |
| Comparative Example 4 | 2 | No Good |

Note:
(1) In the column of the single color printing in the above Table, score 1 indicates that there are too many dot-shaped voids in the printed images so that the printed images are illegible; or score 2, there are many dot-shaped voids, but the printed images are legible; and score 3, the printed images are free from dot-shaped voids, clear and legible.
(2) In the column of the multiple superimposing printing, the term "Good" indicates that the superimposing of colors is completely uniform; and the term "No Good" indicates that the superimposing of colors is not made at all.

What is claimed is:

1. A thermosensitive image transfer recording medium comprising:

a) a support, b) a peel-off layer formed on said support, which comprises as a main component a thermofusible material, said peel-off layer having a melt viscosity A, and c) a transparent thermofusible ink layer comprising a plurality of different color ink sections formed side by side in the form of a repeating unit on said peel-off layer, each of said ink sections comprising as the main components a thermofusible resin and a coloring agent, said transparent thermofusible ink layer having a melt viscosity B which is larger than the melt viscosity A of said peel-off layer, with the melt viscosity A of said peel-off layer being in the range of 10 cps to 10,000 cps at 110° C. and the melt viscosity B of said thermofusible ink layer being in the range of 100 cps to 500,000 cps at 110° C., and wherein said peel-off layer has an endothermic capacity in the range of 20 to 65 mcal/mg and said thermofusible ink layer has an endothermic capacity of 10 mcal/mg or less.

2. The thermosensitive image transfer recording medium as claimed in claim 1, wherein said repeating unit comprises a yellow thermofusible ink section, a magenta thermofusible ink section and a cyan thermofusible ink section.

3. The thermosensitive image transfer recording medium as claimed in claim 1, wherein said repeating unit comprises a yellow thermofusible ink section, a magenta thermofusible ink section, a cyan thermofusible ink section and a black thermofusible ink section.

4. The thermosensitive image transfer recording medium as claimed in claim 1, wherein said plurality of thermofusible ink sections are in the form of stripes extending in one direction across said peel-off layer with one or more narrow markers extending in the same direction, for identifying the color of adjacent ink sections, said narrow mark being interposed between said adjacent ink sections.

5. The thermosensitive image transfer recording medium as claimed in claim 1, wherein said support is a heat resistant sheet-shaped material.

6. The thermosensitive image transfer recording medium as claimed in claim 5, wherein said heat resistant sheet-shaped material is selected from the group consisting of polyester, polycarbonate, triacetylcellulose, nylon and polyimide sheets.

7. The thermosensitive image transfer recording medium as claimed in claim 1, wherein said peel-off layer has a thickness ranging from 1.0 μm to 6.0 μm.

8. The thermosensitive image transfer recording medium as claimed in claim 7, wherein said peel-off layer has a thickness ranging from 2.0 μm to 4.0 μm.

9. The thermosensitive image transfer recording medium as claimed in claim 7, wherein said thermofusible ink layer has a thickness ranging from 0.5 μm to 2.5 μm.

10. The thermosensitive image transfer recording medium as claimed in claim 1, wherein said thermofusible ink layer has a thickness ranging from 0.2 μm to 5.0 μm.

11. The thermosensitive image transfer recording medium as claimed in claim 1, wherein said thermofusible material is a wax.

12. The thermosensitive image transfer recording medium as claimed in claim 11, wherein said wax is a natural wax selected from the group consisting of spermaceti, bees wax, lanolin, carnauba wax, candelilla wax, montan wax, cercin wax, paraffin was, microcrystalline wax, oxidized wax and ester wax.

13. The thermosensitive image transfer recording medium as claimed in claim 1, wherein said thermofusible material in said peel-off layer is a higher fatty acid.

14. The thermosensitive image transfer recording medium as claimed in claim 13, wherein said higher fatty acid is selected from the group consisting of lauric acid, myristic acid, palmitic acid, stearic acid and behenic acid.

15. The thermosensitive image transfer recording medium as claimed in claim 1, wherein said thermofusible material is a higher alcohol.

16. The thermosensitive image transfer recording medium as claimed in claim 15, wherein said higher alcohol is stearyl alcohol or behenyl alcohol.

17. The thermosensitive image transfer recording medium as claimed in claim 1, wherein said thermofusible material is a fatty acid ester.

18. The thermosensitive image transfer recording medium as claimed in claim 17, wherein said fatty acid ester is a fatty acid ester of sucrose or of sorbitan.

19. The thermosensitive image transfer recording medium as claimed in claim 1, wherein said peel-off layer is formed on said support by applying said thermofusible material to said support by a hot-melt coating method.

20. The thermosensitive image transfer recording medium as claimed in claim 1, wherein said peel-off layer is formed on said support by applying said thermofusible material to said support by a solvent coating method.

21. The thermosensitive image transfer recording medium as claimed in claim 1, wherein said thermofusible ink layer is formed on said peel-off layer by the gravure printing method.

22. The thermosensitive image transfer recording medium as claimed in claim 1, wherein said thermofusible ink layer is formed on said peel-off layer by the flexography printing method.

23. The thermosensitive image transfer recording medium as claimed in claim 1, wherein said thermofusible resin and said coloring agent are used in a weight ratio of 1:about 0.01 to about 0.63.

* * * * *

UNITED STATES PATENT AND TRADEMARK OFFICE

CERTIFICATE OF CORRECTION

PATENT NO. : 5,053,267

DATED : OCTOBER 1, 1991

INVENTOR(S) : YOUJI IDE ET AL

It is certified that error appears in the above-identified patent and that said Letters Patent is hereby corrected as shown below:

Title page, Item [30], the priority, date of Japanese 63-11792 should be changed from "Feb. 21, 1988" to --Jan. 21, 1988--.

Column 2, line 3, delete "the" (first occurrence);

Column 5, line 12, change "feature" to --features--;

Column 10, line 36, delete "was" (first occurrence);

Column 13, line 18, delete ",";

Column 13, line 19, delete ",", same line, change "mark" to --markers--;

Column 13, line 23, after "heat" insert -- - --;

Column 13, line 25, after "heat" insert -- - --;

Column 14, line 2, after "paraffin" change "was" to --wax--.

Signed and Sealed this

Ninth Day of November, 1993

*Attest:*

*Attesting Officer*

Bruce Lehman

BRUCE LEHMAN

*Commissioner of Patents and Trademarks*